US005372609A

United States Patent [19]

Weiser et al.

[11] Patent Number: 5,372,609

[45] Date of Patent: Dec. 13, 1994

[54] SELF-TANNING, PRETANNING AND ASSIST TANNING OF PELTS AND SKIN PELTS AND RETANNING OF LEATHER AND SKIN

[75] Inventors: Juergen Weiser, Schriesheim; Wolfgang Reuther, Heidelberg; Hermann Birkhofer, Ludwigshafen; Karl Stork, Weisenheim a. Berg; Ortwin Schaffer, Ludwigshafen, all of Germany

[73] Assignee: BASF Aktiengesellschaft, Ludwigshafen, Germany

[21] Appl. No.: 94,026

[22] PCT Filed: Jan. 21, 1992

[86] PCT No.: PCT/EP92/00116

§ 371 Date: Jul. 29, 1993

§ 102(e) Date: Jul. 29, 1993

[87] PCT Pub. No.: WO92/13105

PCT Pub. Date: Aug. 6, 1992

[30] Foreign Application Priority Data

Jan. 29, 1991 [DE] Germany ..... 4102545

[51] Int. Cl.[5] ..... C14C 3/16

[52] U.S. Cl. ..... 8/94.33; 8/94.18; 8/94.21; 252/8.9

[58] Field of Search ..... 8/94.33, 94.21, 94.18; 252/8.9

[56] References Cited

U.S. PATENT DOCUMENTS

| | | |
|---|---|---|
| 2,351,338 | 6/1944 | Howard . |
| 2,516,283 | 7/1950 | Winheim et al. . |
| 3,080,281 | 3/1963 | Fischer et al. . |

FOREIGN PATENT DOCUMENTS

| | | |
|---|---|---|
| 0225491 | 6/1987 | European Pat. Off. . |
| 1769059 | 8/1971 | Germany . |
| 2137603 | 2/1973 | Germany . |
| 2549527 | 5/1977 | Germany . |

OTHER PUBLICATIONS

English abstracts of Gustavson, *Svensk Kem. Tid.*, 61, 114 (1949).

*Primary Examiner*—Prince Willis, Jr.
*Assistant Examiner*—Alan D. Diamond
*Attorney, Agent, or Firm*—Oblon, Spivak, McClelland, Maier & Neustadt

[57] ABSTRACT

Pelts and skin pelts can be self-tanned, pretanned and assist tanned and leather and skin can be retanned by using for this purpose the compound I or an acetal thereof.

6 Claims, No Drawings

SELF-TANNING, PRETANNING AND ASSIST TANNING OF PELTS AND SKIN PELTS AND RETANNING OF LEATHER AND SKIN

This application is a 371 of PCT/EP92/00116 filed Jan. 21, 1992.

The present invention relates to an improved process for self-tanning, pretanning and assist tanning pelts and skin pelts and for retanning leather and skin.

Aldehydes and in particular dialdehydes such as glutardialdehyde are frequently described in the literature and used in practice as tanning agents for leather. For instance, DE-A-17 69 059 describes a process for making leather by treating tannable material with zinc salts, water-soluble sulfates and aldehydes or aldehyde-eliminating substances and aftertreating with basifying agents.

However, these processes and the leather and skin obtained by these processes frequently have a number of disadvantages. The leather obtained, especially by tanning with glutardialdehyde, is frequently yellowed; particularly noticeable problems can arise when glutardialdehyde is used as a tanning agent for fur, since fur thus tanned can be strongly yellowed not only on the flesh side but also on the hair side. Furthermore, because the aldehydes used are highly volatile and frequently very toxic or otherwise potentially injurious to health, safety measures need to be taken and a relatively large amount of the aldehyde tanning agent needs to be used.

It is an object of the present invention to provide novel tanning agents for self-, pre-, assist- and re-tanning which are free of the disadvantages of the prior art.

We have found that this object is achieved by an improved process for self-tanning, pretanning and assist tanning pelts and skin pelts and for retanning leather and skin, which comprises using for this purpose the compound of the formula I

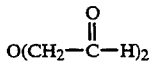

(I)

or an acetal thereof.

Besides -3-oxoglulardialdehyde compound I itself it is also possible to use the corresponding acetals The acetal radicals used are customarily the radicals customary for this purpose, for example $C_1$–$C_8$-alkyl groups, preferably $C_1$–$C_4$-alkyl groups, such as methyl, ethyl, n-propyl, n-butyl or 2-ethylhexyl. The two acetal radicals can be different or preferably identical. Furthermore, these two radicals can be linked to one another to form a five- or six-membered ring, for example a 1,3-dioxolane, 1,3-dioxane, 5,5-dimethyl-1,3-dioxane or 5-n-butyl-5-ethyl-1,3-dioxane ring.

The compounds I and the acetals or ketals thereof are known in principle; they are preparable by literature methods.

The tanning process of the present invention is highly suitable for self-tanning and pretanning pelts and skin pelts in aqueous liquor. This is advantageously done by treating the pickled pelts, for example cattle pelts having a split thickness of from 1.5 to 4 mm, or skin pelts, for example sheepskin pelts, with an aqueous solution or dispersion of carbonyl compounds I at a pH of from 2 to 7, in particular from 2.5 to 4, and at from 15° to 50° C., in particular at from 25 to 45° C., for a period of from 3 to 20 hours. The treatment takes the form for example of milling in a drum. The amount of carbonyl compound I required is normally, based on the pelt weight, from 2 to 30% by weight, in particular from 5 to 20% by weight. The liquor length, i.e. the percentage weight ratio of treatment liquor to goods, is customarily from 30 to 200% in the case of pelts or from 100 to 2000% in the case of skin pelts, in either case based on the pelt weight.

On completion of the treatment the leather or skin is customarily brought to a pH of from 4 to 8, in particular 5 to 7, using for example magnesium oxide, sodium carbonate or sodium bicarbonate, optionally treated with further tanning agents and, on completion of the tanning process, optionally dyed and fatliquored.

The tanning process of the present invention is likewise highly suitable for assist tanning pelts and skin pelts together with the tanning agents of the main tannage, which can be for example a chrome or aluminum tannage. In this case the working conditions concerning pH, temperature and duration of treatment are adjusted to the requirements of the main components of the tanning; the same applies to the treatment apparatus and the liquor length and also to the aftertreatment. In this case the amount of carbonyl compound I required is normally, based on the pelt weight, from 0.1 to 20% by weight, in particular from 0.5 to 15% by weight.

The tanning process of the present invention is similarly highly suitable for retanning previously tanned leather and skin, for example chrome tanned leather, in an aqueous liquor. It is generally carried out by tanning the pickled pelts and skins, for example cattle pelts having split thicknesses of from 1.5 to 4 mm, with for example a customary chromium-containing tanning agent such as a chromium(III) salt, e.g. chromium(III) sulfate, in a conventional manner, deacidifying the resulting pretanned hides (wet blues in the case of chrome tanning) and treating the deacidified hides at a pH of from 2 to 7, in particular from 2.5 to 4, and at from 15° to 50° C., in particular at from 25° to 45° C., with an aqueous solution or dispersion of carbonyl compounds I for a period of from 1 to 12 hours. This treatment takes the form for example of milling in a drum. The amount of carbonyl compounds I required is normally, based on the shaved weight of the leather, from 2 to 30% by weight, in particular from 5 to 20% by weight. The liquor length is customarily from 30 to 200% in the case of pelts or from 100 to 2000% in the case of skin pelts, in either case based on the shaved weight of the leather.

After the treatment and if necessary also beforehand, the leather or skin is customarily adjusted to a pH of from 3 to 5, using for example magnesium oxide or an organic acid such as formic acid or salts thereof, and after the treatment it is if desired dyed and fat-liquored.

The leather or skin which has been retanned according to the present invention may have been additionally treated with other tanning agents such as polymer tanning agents or syntans prior to the retanning with the carbonyl compounds I. Moreover, the carbonyl compounds I can be used simultaneously with such additional tanning agents, for example in the main tannage.

Suitable additional or simultaneous tanning agents are all customary agents having a tanning effect on pelts or skin pelts. A comprehensive treatment of such tanning agents may be found for example in Ullmanns Encyklopädie der technischen Chemie, 3rd edition, Volume 11, pages 585 to 612 (1960). Specific tanning agent classes which may be mentioned are the mineral tanning agents, for example chromium, aluminum, zinc or zirconium salts, the synthetic tanning agents such as the above-mentioned polymer tanning agents and syntans, and the vegetable (plant derived) tanning agents or tannins.

The tanning process of the present invention produces leathers and furs which, compared with the products obtained using the prior art aldehyde tanning agents such as glutardialdehyde, possess not only a full and very soft handle and high shrinkage temperatures but also a distinctly improved tensile and tear strength. Moreover, leathers and skins tanned according to the present invention are noticeably free of any yellow color.

A further advantage of the tanning process of the present invention is the low volatility of the carbonyl compounds I used, as is evident for example from the comparatively small amount required of these tanning agents. Furthermore, the carbonyl compounds I are in a certain sense universal tanning agents, since they can be combined with all other customary tanning agents and are usable not only for self-tanning, pretanning and assist tanning but also for retanning.

EXAMPLES

Example 1

Self-tanning of cattle pelts with 3-oxaglutardialdehyde

Thoroughly delimed and pickled cattle pelt having a split thickness of 2 mm was admixed at a liquor length of 140% with 5% by weight of 3-oxaglutardialdehyde, based on the split weight of the pelt, and drummed at 40° C. and about pH 2.8 for 3 hours. Then the pH was adjusted to 5.8–6.0 with magnesium oxide. After a brief rinse, the leather was finished as usual.

The result obtained was a white leather having a shrinkage temperature of about 85° C., which was very soft and pliable.

Example 2

Retanning of chrome-tanned cattle leather with 3-oxaglutardialdehyde

A customarily produced cattle wet blue of shaved thickness 1.5 mm was admixed at a liquor length of 100% with 2.5% by weight of 3-oxaglutardialdehyde, based on the shaved weight of the leather, and drummed at 40° C. and about pH 3.4 for 1.5 hours. Then the pH was adjusted to 4.6 with a mixture of 1% by weight of sodium formate and 0.5% by weight of sodium bicarbonate, each percentage being based on the shaved weight of the leather.

Subsequent dyeing with a customary leather dye, fatliquoring with a customary fatliquor and customary finishing produced a soft, full and pliable leather.

Example 3

Assist tanning (pretanning) with 3-oxaglutardialdehyde in the aluminum tanning of cattle pelts Thoroughly delimed and pickled cattle pelt having a split thickness of 2 mm was admixed at a liquor length of 140% with 5% by weight of 3-oxaglutardialdehyde, based on the split weight of the pelt, added in three portions at one hour intervals and drummed at 40° C. and pH 3.2 for 3 hours in total. Then 8% by weight of aluminum sulfate (free of water of crystallization), based on the split weight of the pelt, were added and the treatment was continued at the same temperature for a further 4 hours. Thereafter the pH was readjusted to about 3.2 with sodium acetate. Following a further hour of drumming at 40° C. the pH was raised to 4.5–5.0 with magnesium oxide and the leather was finished as usual.

The result obtained was a soft and pliable leather having a shrinkage temperature of about 90° C.

Example 4

Self-tanning of sheepskin pelt with 3-oxaglutardialdehyde

Customary sheepskin pelts were admixed at a liquor length of 1500% with 60% by weight of sodium chloride, 12% by weight of customary fatliquor and 18% by weight of 3-oxaglutardialdehyde, each percentage being based on the dry weight of the skin pelt, and drummed at 35° C. and pH 3.2 for 4 hours. Thereafter the pH was adjusted to 5.5 with sodium carbonate.

Subsequent drying, sawdusting, staking, combing and fleshing produced a skin having a shrinkage temperature of 70° C.

We claim:

1. A process for self-tanning, pretanning and assist tanning pelts and skin pelts and for retanning leather and skin, which comprises contacting said pelts, skin pelts, leather or skin with a compound of the formula I $$O(CH_2-\overset{\overset{\displaystyle O}{\|}}{C}-H)_2$$

or an acetal thereof.

2. The process as claimed in claim 1, wherein said acetal is a $C_1$–$C_8$ alkyl acetal and wherein the acetals formed at each carbonyl functionality in formula (I) are the same or different.

3. The process as claimed in claim 2, wherein the acetals formed at each carbonyl functionality of formula (I) are the same.

4. The process as claimed in claim 2, wherein said acetal is a $C_1$–$C_4$ alkyl acetal.

5. The process as claimed in claim 1, wherein said pelts, skin pelts, leather or skin is contacted with a compound of formula I.

6. The process as claimed in claim 1, wherein said pelts, skin pelts, leather or skin is contacted with an acetal of formula I.

* * * * *